United States Patent [19]

Tippmann

[11] Patent Number: 4,981,171

[45] Date of Patent: Jan. 1, 1991

[54] HEAT EXCHANGE COIL

[75] Inventor: Robert T. Tippmann, Fort Wayne, Ind.

[73] Assignee: Rite Coil, Inc., New Haven, Ind.

[21] Appl. No.: 243,811

[22] Filed: Sep. 13, 1988

[51] Int. Cl.[5] ..... F28D 7/10

[52] U.S. Cl. ..... 165/125; 62/272

[58] Field of Search ..... 165/125, 162; 62/272

[56] References Cited

U.S. PATENT DOCUMENTS

| | | | |
|---|---|---|---|
| 1,853,322 | 4/1932 | Rose | 165/125 X |
| 1,872,785 | 8/1932 | Modine | 165/125 |
| 2,128,763 | 8/1938 | Whitlark et al. | 165/125 X |
| 2,213,463 | 9/1940 | Fink | 165/125 X |
| 2,312,767 | 3/1943 | Myerhoefer | 165/125 X |
| 2,316,098 | 4/1943 | Moss et al. | 165/125 X |
| 2,318,393 | 5/1943 | Honerkamp et al. | 165/125 X |
| 2,368,518 | 1/1945 | Briskin et al. | 165/125 X |
| 2,370,309 | 2/1945 | Hartwig | 165/125 X |
| 2,454,654 | 11/1948 | Kaufman | 165/125 X |
| 2,519,496 | 8/1950 | Norman | 165/125 X |
| 4,615,176 | 10/1986 | Tippman | 62/272 X |

FOREIGN PATENT DOCUMENTS

| | | | |
|---|---|---|---|
| 984944 | 7/1951 | France | 165/125 |
| 352089 | 3/1961 | Switzerland | 165/125 |
| 2065860 | 7/1981 | United Kingdom | 165/125 |

*Primary Examiner*—Gerald A. Michalsky

*Attorney, Agent, or Firm*—Jeffers, Hoffman & Niewyk

[57] ABSTRACT

A heat exchanger for an air heating and cooling apparatus includes a plurality of exteriorly-finless hollow refrigerant-carrying stainless steel spirally wound coils being of flattened oval shape in cross-section and a plurality of angularly-spaced criss-cross grid-forming structures for supporting the coils in spaced-apart relation and aligned in columns and rows in a stack thereof for permitting passage of external air flow across and between the coils. The spirally wound coils are supported by the grid structures to have an annular-shaped configuration defining an open interior in the coil stack core. The flattened oval cross-sectional shape of each coil defines a pair of arcuate opposite end wall portions and a pair of planar opposite side wall portions extending between and interconnecting the arcuate sidewall portions such that in an axial section taken through the coil stack the arcuate side wall portions of adjacent coils are disposed in spaced apart facing relation and said planar side wall portions of adjacent coils are disposed in spaced apart facing relation and define therebetween channels having generally laminar flow-generating characteristics for permitting flow of the air through the channels at an improved rate.

22 Claims, 2 Drawing Sheets

HEAT EXCHANGE COIL

BACKGROUND OF THE INVENTION

The present invention generally relates to refrigeration equipment and, more particularly, is concerned with a heat transfer core for an air cooling apparatus comprising an annular stack of spaced-apart finless, hollow coils of flattened oval shape in cross-section for improved sanitation and air flow efficiency.

In meat and other food processing installations, it is necessary to maintain the temperature of the processing room at a relatively low level to prevent the growth of bacteria. In order to cool food processing facilities of this type, large evaporator coils are typically mounted near the ceiling and air is circulated through them to maintain the temperature of the facility at an acceptably low level. One type of prior art evaporator comprises a plurality of finned tubes in a rectangular configuration wherein the tubes are positioned in staggered relationship to the flow of air. The reasoning was that the staggered arrangement would produce better contact between the flowing recirculating air and the heat exchanger tubes.

A further type of prior art heat exchange coil is shown in U.S. Pat. No. 4,615,176, in the name of the inventor herein. This heat exchange coil unit comprises a plurality of finned stainless steel coils arranged in an annular fashion with rows of individual coils in radial alignment and the coils being stacked in vertical, axial alignment. In this heat exchanger unit, the tubing of the coils is circular in transverse cross-section.

A problem with both the rectangular and annular prior art evaporators is that the static and velocity pressures, which are a measure of the resistance to air flow through the heat exchanger, are relatively high thereby requiring the use of larger motors to move a given volume of air through the coil stack. In the case of the rectangular heat exchanger, the staggered arrangement of the individual coils or tubing causes the air to flow in a tortuous path through the unit. In one prior art rectangular condenser, the tubes are flattened to an oval shape, but the tubing is arranged in a staggered pattern, thereby providing the high static and velocity pressures referred to above. In the case of round cross-section tubing, even if it is arranged in straight rows and columns, the flow of air across it will be quite turbulent as air streams encounter the arcuate surfaces and thus change direction several times to flow past and around any given tube. This results in a speeding up and slowing down of the air flow around the tube, which greatly increases static pressure due to the resulting turbulence.

Refrigeration equipment is typically employed for cooling meat and food products to retard bacterial growth thereon. Facilities used for meat and food product processing must adhere to strict sanitation requirements. Heretofore, the refrigeration equipment was not likely to be considered when steps were taken to improve sanitation conditions. One reason for this oversight was because the selection between different refrigeration equipment was limited in view that most incorporated a stack of galvanized coils with closely spaced fins on their exterior. The finned galvanized coils have many cracks and crevices for bacteria to grow in and there are areas difficult to clean.

To prevent outbreaks of contamination, the food industry has been looking for innovative ways to combat bacteria growth. Part of the invention herein is the recognition by applicant that coil stack design for refrigeration equipment should be considered together with other measures to improve sanitation at meat and food processing facilities. Along with energy and cooling efficiency, the capability of cleaning the coil bundle and of it remaining clean for an extended period of use, without adversel affecting operating efficiency, should be an important performance objective. Consequently, a need exists for an alternative coil bundle or stack construction which will improve sanitation conditions while, at a minimum, maintaining present energy and cooling efficiencies.

SUMMARY OF THE INVENTION

The present invention provides a heat transfer core for an air cooling apparatus designed to satisfy the aforementioned needs. The heat transfer core according to one form of the present invention incorporates an annular stack or bundle of spaced apart finless, hollow coils of tubing being flattened oval-shaped in cross-section and generally aligned in columns and rows. The finless oblong coils improve dramatically air flow efficiency when compared to the prior art coil stack constructions employing finned coils and non-finned round coils.

More particularly, the improved oblong cross-sectional shape of the coil takes better advantage of the air flowing over the coil by providing much better air wipe using more of the coil's surface area as the air flows more aerodynamically with less turbulence over the coil. Also, air flows at a substantially higher rate between the coils and across a substantially greater amount of surface area than in the case of prior art designs, thereby improving cooling efficiency.

Another advantage of the improved oblong shape is that the refrigerant flowing inside the coil has a wider surface area to contact and interface thermally with the external air flow, which causes it to transfer heat more efficiently. A further advantage of the oblong cross-sectional configuration is that much more coil can be stacked in a given area, thereby providing substantial space savings. Because the flattened oval-shaped coils are arranged in straight rows in the direction of air flow through the coil, which is preferably in a radial direction, the flow of air through the coil stack is substantially laminar, as opposed to prior art designs wherein the coils are arranged in a staggered fashion. This straight row, oval coil design also permits much easier cleaning.

Accordingly, the present invention is directed to a heat transfer core for an air cooling apparatus which comprises: a plurality of exteriorly-finless hollow coils for carrying an internal flow of a first fluid, each coil being of flattened oval shape in cross-section; and means for supporting the coils in spaced-apart relation and generally aligned in rows in a stack thereof for permitting the passage of an external flow of a second fluid across and between the coils.

More particularly, the flattened oval cross-sectional shape of each coil defines a pair of generally arcuate opposite side wall portions and a pair of generally planar opposite top and bottom wall portions extending between and interconnecting the arcuate side wall portions such that in an axial section taken through the coil stack, the arcuate side wall portions of adjacent coils are disposed in spaced apart facing relation and the planar wall portions of adjacent coils are disposed in spaced apart facing relation and define therebetween open channels having generally laminar flow-generating characteristics for permitting flow of air through the channels at an improved rate.

Further, the coil-supporting means is preferably a plurality of angularly-spaced criss-cross grid structures. The coils are generally spirally wound and serially connected so as to provide a single internal flow path for the first fluid. The grid structures support the coils such that the stack thereof has an annular-shaped configuration defining an open interior in the coil stack core.

Although the invention is most advantageously employed in an evaporator, the same design can be used in a condenser.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
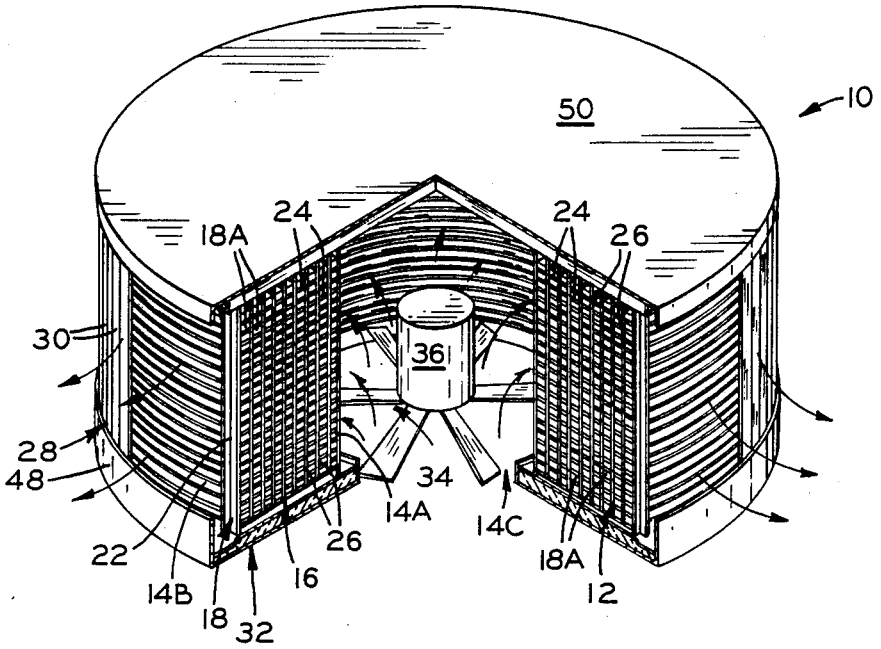
FIG. 1 is a perspective view, with portions sectioned and removed, of an air cooling apparatus incorporating a heat transfer core constructed in accordance with the principles of the present invention.
Figure 2:
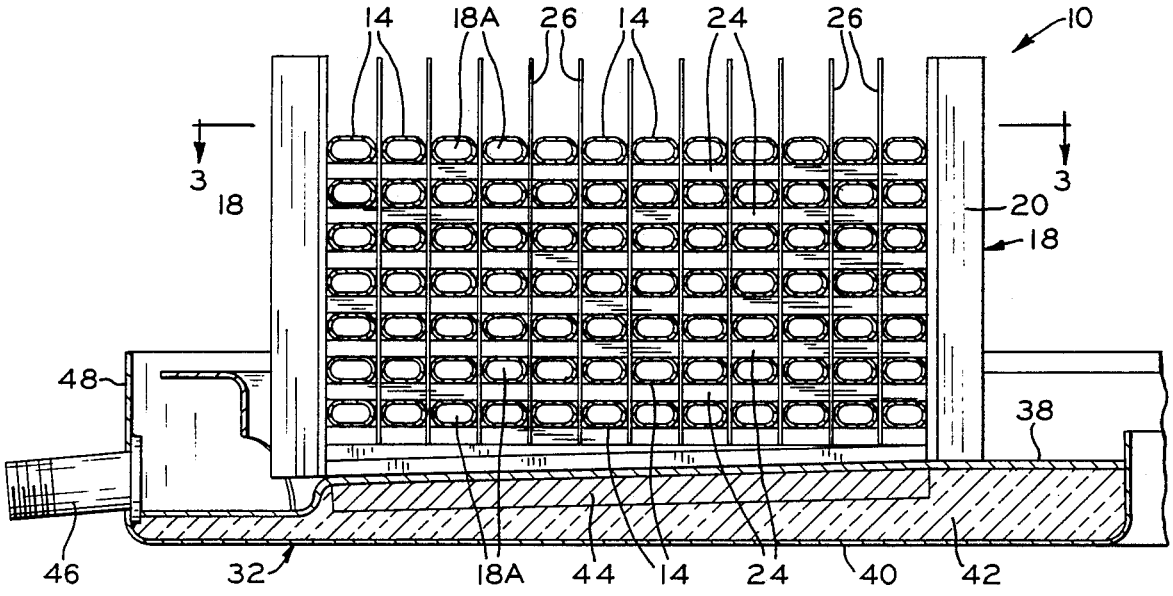
FIG. 2 is an enlarged fragmentary axial sectional view of the lower portion of the apparatus of FIG. 1, showing the coil stack core and condensate collecting pan employed by the apparatus

Referring now to the drawings, and particularly to FIGS. 1 and 2, there is shown an air cooling apparatus, generally designate by the numeral 10, being suited particularly, but not so limited exclusively, for use in refrigeration equipment of the type typically deployed for cooling meat and food processing facilities. In accordance with the present invention, the evaporator 10 includes a heat exchanger or heat transfer core, generally designated 12. The core 12 is an improvement over the core described and illustrated in U.S. Pat. No. 4,615,176 issued to the applicant herein.

In its basic components, the heat transfer core 12 comprises a plurality of hollow spirally wound tubes or coils 14 and means for supporting the coils, generally identified by the reference number 16. In contrast to the exteriorly-finned galvanized coils of the core in the above-cited patent, the coils 14 are exteriorly-finless and preferably composed of stainless steel. Further, in contrast to the round cross-sectional shape of the coils in the above-cited patent, each of the coils 14 of the core 12 are of oblong, or flattened oval, shape in cross-section which provides improved air flow characteristics, as will be described hereinafter The coil-supporting means 16 of the heat exchanger 12 is preferably a plurality of angularly-spaced criss-cross grid-forming structures 18. The coils 14 are generally spirally wound and serially interconnected so as to provide a single internal flow path for a refrigerant carried internally of the coils. Although in the particular embodiment illustrated the coils are wound in horizontal spirals, the core 12 could also be constructed by winding the coils as a vertical helix with such vertically wound coils being nested one inside the other. The present invention is not limited to any particular manner of coil winding. The grid structures 18 define a matrix of openings 18A through which the coils 14 extend and by which the coils are supported to form a stack thereof having an overall annular-shaped configuration. The stack of coils 14 defines an open hollow interior 14C through the heat transfer core 12. The spaced relation of the coils 14 with respect to one another forms open air channels 60 (FIG. 4) and the open interior 14C of the core 12 permits the passage of an external flow of air across and between air entry and exit sides 14A, 14B of the coils and through the stack interior 14C. The entry and exit sides 14A, 14B of the coils 14 are determined by the direction selected for moving air through the coils 14, which can be radially outward or radially inward, depending on the configuration and direction of rotation of fan 34.

Figure 3:
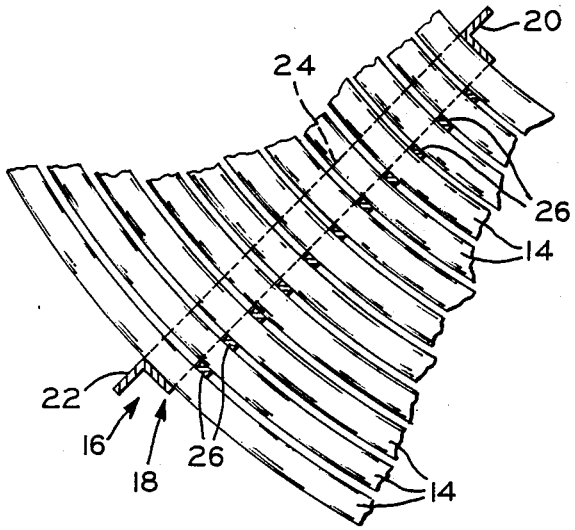
FIG. 3 is a fragmentary transverse sectional view, on a reduced scale, of the coil stack core taken along line 3—3 of FIG. 2.

Referring also to FIG. 3, each grid structure 18 of the coil-supporting means 16 includes a pair of elongated inner and outer flanges 20, 22 disposed at the respective entry and exit sides of the coils and extending in the axial direction of the core 12. Also, each grid structure 18 includes a plurality of elongated radial bars 24 extending between the flanges 20, 22 and rigidly secured thereto. The bars 24 separate the coils 14 into axially-spaced rows thereof. Further, each grid structure 18 includes a plurality of elongated axial strips 26 extending generally parallel to the flanges 20, 22 and spaced from one another along the radius of the core 12. The bars 24 and strips 26 criss-cross one another and together define the grid structure openings 18A through which extend the coils 14.

The air cooling apparatus 10 also includes an air diffuser and moisture collection structure 28 in the form of a plurality of elongated baffle plates 30, a condensate collecting pan 32, and a fan 34 powered by a motor 36 for moving air through the coil core 12. The moisture collection structure 28 is optional, and can be eliminated in certain applications. Furthermore, fan and motor 34 could be located in a duct (not shown) remotely from heat exchanger 10. The collecting pan 32 is attached beneath the core 12 to the underside of the coil-supporting means 16. The pan 32 includes upper and lower spaced bottom walls 38, 40 with insulation 42 to prevent external condensation and a rigid structural member 44 which assists in supporting the coils 14 being disposed between the bottom walls 38, 40. A drain fitting 46 is attached to the side wall 48 of the pan 32.

The air flow diffusing baffle plates 30 are mounted between the pan 32 and a lid 50 which overlies and covers the top of the coil stack and stack interior 14C. The baffle plates 30 are spaced apart from one another about the outer exit side 14B of the core 12 for diffusing air flow exiting from the coil stack and for separating entrained condensate from the air flow before leaving the air cooling apparatus 10. The condensate separated from the air flow by the baffle plates 30 drips or runs down the plates where it is then collected in the pan 32 and routed to the drain fitting 46.

The motor 36 of the air cooling apparatus 10 is mounted to the coil supporting means in a manner not shown, but which can be seen by reference to the above-cited patent. The motor 36 in turn mounts the fan 34 on its rotatable output shaft (not shown) and in alignment with the open, hollow interior 14C of the coil stack for moving air through the stack interior, over the coils 14 from the entry to exit sides 14A, 14B of the coil stack, and through the air diffusing baffle plate 30. The direction in which the fan 34 is rotated will determine the direction of air flow through the apparatus 10.

Figure 4:
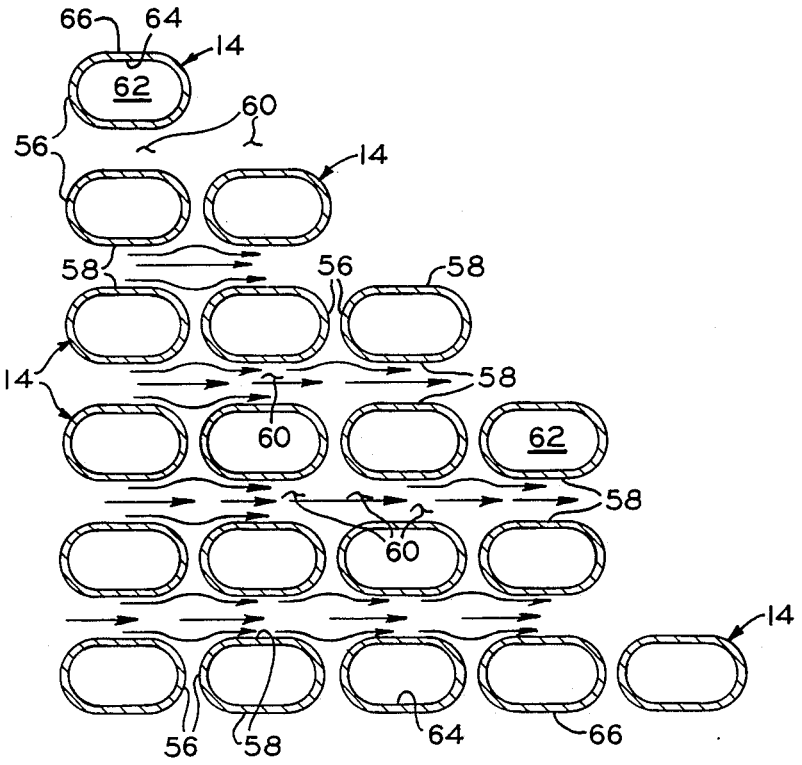
FIG. 4 is a fragmentary axial sectional view of a plurality of spaced-apart non-finned coils of oblong, or flattened oval, cross-sectional shapes incorporated in the coil stack core of the present invention.

By referring now to FIG. 4, the improvements provided by the coils 14 of the core in accordance with the present invention can be better appreciated. FIG. 4 shows the spaced-apart nonfinned coils 14 of oblong, or flattened oval, cross-sectional shapes incorporated in the coil stack core 12 of the present invention. A two-phase refrigerant fluid such as freon or the like flows through the interior 62 of coils 14 and contacts inner surfaces 64 to thereby transfer heat through conduction from the outer surfaces 66, which are in contact with the flow of air through the coil stack. Regardless of whether the prior art round coils are staggered or offset from one another or aligned in rows and columns like the coils 14 of FIG. 4, the prior art round coils define channels therebetween producing generally transversely pulsating, turbulent flow patterns, in which there is speeding up and slowing down of the air as it flows through the channels. This creates higher static and velocity pressures and reduces the efficiency of the apparatus by increasing the horsepower required to move air at a given rate.

In contrast thereto, the flattened oval, or oblong, cross-sectional shape of each coil 14 seen in FIG. 4 defines a pair of generally arcuate opposite side wall portions 56 and a pair of generally planar opposite top and bottom wall portions 58 extending between and interconnecting the arcuate side wall portions 56 which improves the flow pattern through the coils 14. Specifically, in the axial section taken through the coil stack in FIG. 4, it can be seen that the arcuate side wall portions 56 of adjacent coils 14 almost touch each other and are disposed in close spaced apart facing relation and the planar top and bottom wall portions 58 of adjacent coils 14 are disposed in spaced apart facing relation but not as close to one another as the arcuate side portions. Further, the planar side wall portions 58 are generally aligned with the air flow direction so as to define therebetween channels 60 having generally laminar flow-generating characteristics for permitting flow of air through the channels 60 at an improved rate. For example, average air flow rates in the range of 1300 to 1400 feet per minute compared to 700 feet per minute have been achieved.

The core coils 14 of the present invention can also be easily cleaned using the conventional cleaning methods of spraying foam, rinsing and disinfecting. The presence of open channels 60 and the relatively flat and straight sides of the channels achieved by the outer surfaces 66 of side portions 58 clearly facilitate cleaning of the coil core 14.

The use of stainless steel instead of galvanized steel results in the coils 14 having greater strength allowing use of lighter weight tubing, about one-half as much weight as a galvanized coil of equal capacity. The flattened oval cross-sectional shape allows a larger amount of tubing to be put in a given area. This makes retrofitting easier.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. An evaporator comprising:

a plurality of exteriorly finless hollow coils of tubing having a two-phase refrigerant fluid therein, said tubing being of flattened oval shape in transverse cross-section having arcuate opposite side wall portions and vertically spaced generally planar opposite top and bottom wall portions;

means for supporting said coils in spaced-apart stacked relation and generally aligned in rows such that adjacent coils in a row are arranged end-to-end; and means for causing air to flow through the stack of coils;

said rows being spaced apart to form open air channels parallel to the direction of air flow through the stack of coils, the arcuate side wall portions of adjacent coils being in sufficiently close proximity that air flows through said channels in a laminar fashion at an improved rate with low turbulence.

2. The evaporator of claim 1, wherein said coils are composed of stainless steel.

3. The evaporator of claim 1, wherein said arcuate side wall portions of adjacent coils are disposed in spaced apart facing relation and said planar wall portions of adjacent coils are disposed in spaced apart facing relation and define therebetween said air channels having generally laminar flow-generating characteristics for permitting flow of air through said channels at an improved rate.

4. The evaporator of claim 1, wherein said coils are stacked and aligned in a direction generally perpendicular to the direction of air flow.

5. The evaporator of claim 1, wherein said coils are generally spirally wound and serially connected so as to provide a single internal flow path for the first fluid.

6. The evaporator of claim 5, wherein said spirally-wound coils are supported by said supporting means such that said stack thereof has an annular-shaped configuration defining an open interior in said coil stack.

7. The evaporator of claim 1, wherein said coils are arranged in an annular stack of horizontal rows defining an open interior, and said means for flowing air comprises impeller means located at said open interior for flowing air radially through said air channels.

8. The evaporator of claim 1, wherein said coils are arranged in an annular stack of rows such that said open air channels are radially oriented, said coils further defining an open interior.

9. The evaporator of claim 8, wherein said coils are further arranged in a plurality of axially oriented columns.

10. In an air heating or cooling apparatus, an evaporator comprising:

a plurality of exteriorly-finless hollow refrigerant-carrying spirally-wound coils being of oblong shape in cross-section, said coils having a two-phase refrigerant fluid therein; and means for supporting said coils in spaced-apart relation and generally aligned in rows in annular-shaped stack thereof having a hollow interior for permitting the passage of an external flow of air across and between the rows of coils and through the stack interior;

said oblong cross-sectional shape of said coils defining a pair of generally arcuate opposite side wall portions and a pair of vertically spaced generally planar opposite top and bottom wall portions extending between and interconnecting said arcuate side wall portions such that in an axial section taken through said coil stack said arcuate side wall portions of adjacent coils are disposed in facing relation and said planar wall portion of adjacent coils are disposed in spaced apart generally facing relation and define therebetween air flow channels, the arcuate side wall portions of adjacent said coils almost touching such that said air channels have generally laminar flow-generating characteristics for permitting flow of air through said channels at an improved rate with reduced turbulence.

11. The heat exchanger of claim 10, wherein said coils are serially connected so as to provide a single internal flow path for the first fluid.

12. In an air heating or cooling apparatus, the combination comprising:

an evaporator core including a plurality of exteriorly-finless hollow spirally-wound refrigerant-carrying coils being of oblong shape in cross section, said coils having a two-phase refrigerant fluid therein, and means for supporting said coils in stacked spaced-apart relation and generally aligned in columns and rows to form an annular-shaped stack thereof having a hollow interior for permitting the passage of an external flow of air across and between air entry and exit sides of said coils and through said stack interior; and a motor-driven fan mounted to said coil-supporting means and aligned with said hollow interior of said coil stack for moving air through said stack interior, over said coils and through channels defined therebetween from said entry to exit sides of said coil stack, said oblong cross-sectional shape of said coils defining a pair of generally arcuate opposite side wall portions and a pair of vertically spaced generally planar opposite top and bottom wall portions extending between and interconnecting said arcuate side wall portions such that in an axial section taken through said coil stack said arcuate side wall portions of adjacent coils are disposed in facing relation, the arcuate side wall portions of adjacent said coils being in sufficiently close proximity that air flows through said channels in a laminar fashion at an improved rate with low turbulence, each of said channels having a radially inner opening communicating directly with the hollow interior and a radially outer opening communicating directly with the surrounding ambient.

13. The apparatus as recited in claim 12, wherein said coil-supporting means is a plurality of angularly-spaced criss-cross grid-forming structures.

14. The apparatus as recited in claim 12, wherein said coils are serially connected so as to provide a single internal flow path for the refrigerant fluid.

15. The apparatus as recited in claim 12, including air diffusing means comprising a plurality of elongated baffle plates arranged in spaced-apart relation along and individually extending axially between opposite ends of said coils stack.

16. The apparatus as recited in claim 15, wherein said air diffusing means is disposed about the exterior side of said coil stack.

17. An evaporator comprising:

a plurality of exteriorly finless hollow coils of tubing having a two-phase refrigerant fluid therein, said tubing being of flattened oval shape in transverse cross-section having arcuate opposite side wall portions and vertically spaced top and bottom wall portions, said bottom wall portion being much flatter interiorly than said side wall portions so that refrigerant flowing through said tubing has increased surface area contact with said bottom wall portion;

means for supporting said coils in spaced-apart stacked relation and generally aligned in rows such that adjacent coils in a row are arranged end-to-end; and means for causing air to flow through the stack of coils;

said rows being spaced apart to form open air channels parallel to the direction of air flow through the stack of coils.

18. The evaporator of claim 17, wherein said arcuate side wall portions of adjacent coils are disposed in spaced apart facing relation and respective said top and bottom wall portions of adjacent coils are disposed in spaced apart facing relation and define therebetween said air channels having generally laminar flow-generating characteristics for permitting flow of air through said channels at an improved rate.

19. The evaporator of claim 18 wherein said coils are stacked and aligned in a direction generally perpendicular to the direction of air flow.

20. The evaporator of claim 17 wherein said coils are stacked and aligned in a direction generally perpendicular to the direction of air flow.

21. The evaporator of claim 17, wherein said coils are arranged in an annular stack of horizontal rows defining an open interior, and said means for flowing air comprises impeller means located at said open interior for flowing air radially through said air channels.

22. The evaporator of claim 17, wherein said coils comprise stainless steel tubing.

* * * * *